US011662675B2

(12) United States Patent
Tezuka

(10) Patent No.: US 11,662,675 B2
(45) Date of Patent: May 30, 2023

(54) IMAGE FORMING APPARATUS

(71) Applicant: CANON KABUSHIKI KAISHA, Tokyo (JP)

(72) Inventor: Shuntaro Tezuka, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/668,668

(22) Filed: Feb. 10, 2022

(65) Prior Publication Data

US 2022/0276588 A1 Sep. 1, 2022

(30) Foreign Application Priority Data

Feb. 26, 2021 (JP) ..... JP2021-030499

(51) Int. Cl.
*G03G 15/16* (2006.01)

(52) U.S. Cl.
CPC ..... *G03G 15/161* (2013.01)

(58) Field of Classification Search
CPC ..... G03G 15/161
See application file for complete search history.

(56) References Cited

U.S. PATENT DOCUMENTS 5,572,305 A * 11/1996 Hayashi ..... G03G 15/163 399/121
2011/0211862 A1 9/2011 Yonemoto

FOREIGN PATENT DOCUMENTS

JP H0466963 A 3/1992
JP H07191557 A 7/1995
JP H07302007 A 11/1995

OTHER PUBLICATIONS

Extended European search report issued in European Appln. No. 22156485.9 dated Aug. 2, 2022.

* cited by examiner

*Primary Examiner* — Clayton E. LaBalle
*Assistant Examiner* — Michael A Harrison
(74) *Attorney, Agent, or Firm* — Rossi, Kimms & McDowell LLP

(57) ABSTRACT

An image forming apparatus includes an image bearing member, an apparatus body including a transfer member movable between a first position and a second position, an opening/closing member. The apparatus body includes a movement mechanism configured to move the transfer member in accordance with a movement of the opening/closing member. The movement mechanism includes a first movable member and a second movable member. The first movable member is configured to move a first end portion of the transfer member from the first position to the second position. The second movable member is configured to move a second end portion of the transfer member from the first position to the second position.

12 Claims, 16 Drawing Sheets

IMAGE FORMING APPARATUS

BACKGROUND OF THE INVENTION

Field of the Invention

The present invention relates to an image forming apparatus for forming an image on a recording material.

Description of the Related Art

In electrophotographic image forming apparatuses, such as copying machines, multifunction machines, and laser beam printers, a toner image formed on a photosensitive member such as a photosensitive drum is transferred to a recording material by a transfer member such as a transfer roller. The photosensitive member and other members arranged in a circumference of the photosensitive member for carrying out the electrophotographic process, such as a developing unit or a charging unit, are configured as a process cartridge that can be integrally attached to and detached from an apparatus body of the image forming apparatus. The user can easily attach or detach the process cartridge when carrying out maintenance operations, such as replacing the process cartridge or removing jammed sheets.

When the transfer member is in contact with the photosensitive member when attaching and detaching the process cartridge, the force applied from the transfer member to the photosensitive member may deteriorate operability during attachment or detachment. Japanese Patent Application Laid-Open Publication No. H04-66963 discloses a printer provided with a front cover that can be opened and closed with respect to a printer body and an opening/closing lever for unlocking the front cover from the printer body, wherein by operating the opening/closing lever, a part of the opening/closing lever causes the transfer roller to separate from the photosensitive drum within the printer body.

According to the document mentioned above, a configuration has been adopted in which the opening/closing lever presses a shaft of the transfer roller directly. However, in a case where the front cover and the transfer roller are arranged distantly due to arrangement limitations, if the opening/closing lever disclosed in the above document is arranged on both sides of the transfer roller in the axial direction, space for moving the opening/closing lever will be required on both sides in the axial direction of the transfer roller, which leads to increased size of the image forming apparatus. Thus, a configuration is awaited in which a mechanism for moving the transfer member in accordance with a movement of the opening/closing member can be arranged in a space-saving manner.

SUMMARY OF THE INVENTION

The present invention provides an image forming apparatus provided with a space-saving configuration by which a transfer member can be moved in accordance with a movement of an opening/closing member.

According to an aspect of the invention, an image bearing member configured to bear an image, an apparatus body including a transfer member configured to transfer the image borne on the image bearing member to a recording material, the transfer member being movable between a first position in which the transfer member is in contact with the image bearing member and a second position in which the transfer member is separated from the image bearing member, and an opening/closing member arranged on a side portion of the apparatus body on a first side in a first direction and movable between an open position and a closed position with respect to the apparatus body, the first direction being a direction orthogonal to a rotational axis direction of the image bearing member, wherein the apparatus body further includes a movement mechanism configured to move the transfer member in accordance with a movement of the opening/closing member, and wherein the movement mechanism includes a first movable member configured to move toward the first side in the first direction in accordance with the movement of the opening/closing member from a closed position to an open position, the first movable member being configured to move a first end portion of the transfer member from the first position to the second position during a movement of the first movable member toward the first side in the first direction, the first movable member being provided on a first side, on which the first end portion is provided, in the rotational axis direction, and a second movable member configured to move in a second direction along the rotational axis direction in accordance with the movement of the first movable member toward the first side in the first direction, the second movable member being configured to move a second end portion of the transfer member from the first position to the second position during a movement of the second movable member in the second direction, the second end portion being provided on a second side opposite from the first side in the rotational axis direction.

Further features of the present invention will become apparent from the following description of exemplary embodiments with reference to the attached drawings.

DESCRIPTION OF THE EMBODIMENTS

Hereafter, embodiments according to the present disclosure will be described with reference to the drawings.

In the following description and drawings, a perpendicular direction, i.e., gravity direction, in a state in which the image forming apparatus is installed on a horizontal plane is referred to as a Z direction or vertical direction. A rotational axis direction of an image bearing member, i.e., electrophotographic photosensitive member, of the image forming apparatus is referred to as a Y direction. A direction intersecting Y and Z directions is referred to as an X direction. The X, Y, and Z directions are preferably mutually intersecting directions perpendicularly to each other. Further, regarding structures, shapes, and arrangements of attachable/detachable members in the image forming apparatus are described by referring to the X, Y, and Z directions based on a state in which the components are assembled to the image forming apparatus, unless denoted otherwise.

First Embodiment

Image Forming Apparatus

Figure 1:
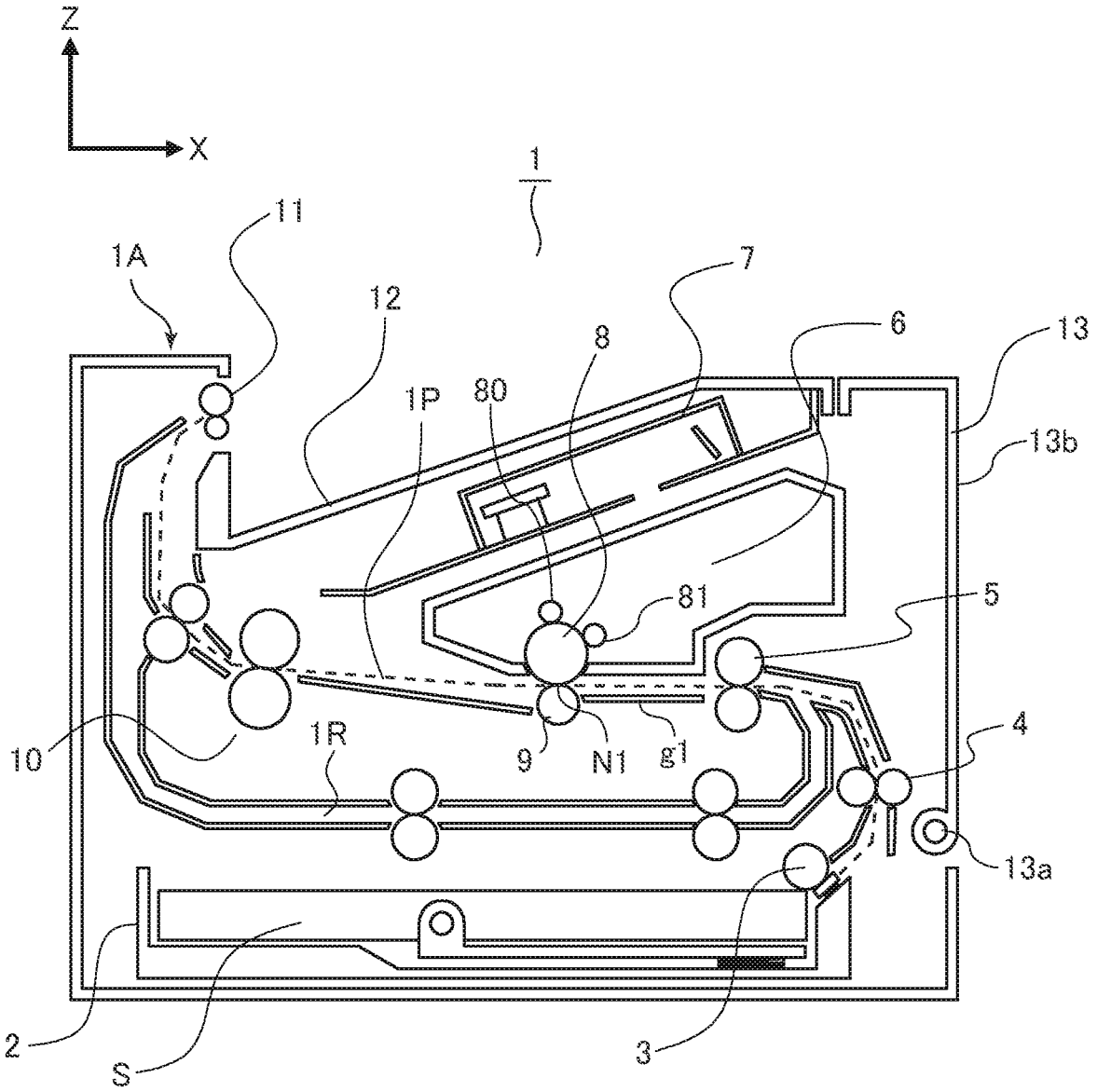
FIG. 1 is a schematic view of an image forming apparatus according to a first embodiment.

FIG. 1 is a schematic view illustrating a cross-sectional structure of an image forming apparatus 1 according to a first embodiment. The image forming apparatus 1 according to the present embodiment is an electrophotographic printer that forms an image on a recording material S through an electrophotographic process based on an image information received from an external device connected via a network and an execution command for forming an image. Various sheets can be used as the recording material S, including paper such as normal paper and thick paper, plastic films, cloth, coated paper and other sheet materials subjected to surface treatment, sheet materials having special shapes such as envelopes and index paper, and other various types of sheets having different sizes and made of different materials.

The image forming apparatus 1 includes a drum-type electrophotographic photosensitive member, hereinafter referred to as photosensitive drum 8, serving as an image bearing member. The photosensitive drum 8 is configured by disposing a photosensitive material such as organic photoconductor (OPC), amorphous selenium, and amorphous silicon on a cylindrical drum base body made for example of aluminum or nickel. The photosensitive drum 8 is supported by an apparatus body 1A of the image forming apparatus 1 in a manner rotatable about a rotational axis extending in the Y direction and driven to rotate at a predetermined speed by a driving source. In the circumference of the photosensitive drum 8 are arranged a charging member 80, a developing member 81, and a transfer roller 9 serving as a transfer member, in the named order in a rotational direction of the photosensitive drum 8. Above the photosensitive drum 8 is arranged a scanner unit 7 serving as an exposing unit.

The photosensitive drum 8, the charging member 80, and the developing member 81 constitute a process cartridge 6 that can be integrally attached to and detached from the apparatus body 1A. A door member 13 serving as an opening/closing member that can be opened and closed with respect to the apparatus body 1A is disposed on one side of the process cartridge 6 in the X direction. By opening the door member 13, attachment and detachment of the process cartridge 6 to and from the apparatus body 1A is allowed from one side in the X direction (i.e., from a downstream side in a first direction described below).

The apparatus body 1A refers to a part of the image forming apparatus 1 excluding the process cartridge 6 and the door member 13, and for example, it includes a metal plate constituting the frame body of the image forming apparatus 1. In the image forming apparatus 1, the one side of the X direction in which the door member 13 is provided is a front side (a side portion) of the image forming apparatus 1, and the opposite side is the rear side of the image forming apparatus 1.

The image forming apparatus 1 further includes a sheet feed cassette 2, a feed roller 3, a conveyance roller pair 4, a registration roller pair 5, a fixing unit 10, a sheet discharge roller pair 11, and a sheet discharge tray 12, in the named order along a main conveyance path 1P of the recording material S. The main conveyance path 1P is a conveyance path, i.e., conveyance space, through which the recording material S is conveyed within the image forming apparatus 1 during image forming operation, and denotes a conveyance path, or conveyance space, leading to the sheet discharge roller pair 11 from the sheet feed cassette 2 accommodating the recording material S.

The sheet feed cassette 2 is arranged below the process cartridge 6. The registration roller pair 5, the photosensitive drum 8, the transfer roller 9, and the fixing unit 10 are arranged along a portion of the main conveyance path 1P extending approximately in the X direction between the process cartridge 6 and the sheet feed cassette 2 in the Z direction. The sheet discharge tray 12 serving as a supporting portion on which the recording material S having an image formed thereon is supported is provided on an upper surface portion of the apparatus body 1A, positioned above the process cartridge 6 and the scanner unit 7.

The sheet feed cassette 2 accommodates the recording material S in a stacked state. The feed roller 3, the conveyance roller pair 4, the registration roller pair 5, the fixing unit 10, and the sheet discharge roller pair 11 constitute a conveyance system in which the recording material S is conveyed within the image forming apparatus 1. The fixing unit 10 also functions as a fixing portion for fixing the image transferred to the recording material S by the transfer roller 9.

The image forming apparatus 1 according to the present embodiment adopts a conveyance path configuration in which the main conveyance path 1P of the recording material S forms an approximately S-shaped curve when viewed in the Y direction, which is the rotational axis direction of the photosensitive drum 8. That is, when viewed in the Y direction, the recording material S is fed to one side in a horizontal direction, i.e., the X direction, from the sheet feed cassette 2, and has an image transferred and fixed thereto while being conveyed on the main conveyance path 1P to the other side in the horizontal direction, i.e., the X direction, above the sheet feed cassette 2. Then, the recording material S is discharged to one side in the horizontal direction, i.e., the X direction, by the sheet discharge roller pair 11, and stacked on the sheet discharge tray 12 provided on the upper surface portion of the apparatus body 1A.

The process cartridge 6 is attached to an attachment space between the main conveyance path 1P and the sheet discharge tray 12, specifically between the main conveyance path 1P and the scanner unit 7, in the Z direction within the apparatus body 1A. By opening the door member 13 to one side in the X direction, the attachment space is opened to one side in the X direction with respect to the external space of the image forming apparatus 1 and the process cartridge 6 is exposed when viewed from one side in the X direction. In this state, the user can access the process cartridge 6 from one side in the X direction to perform attachment and detachment operations.

Image Forming Operation

An image forming operation by the image forming apparatus 1 will be described. At first, the photosensitive drum 8 is driven to rotate, and the surface of the photosensitive drum 8 is charged to predetermined polarity and predetermined potential by the charging member 80. The scanner unit 7 performs an exposing process based on the image information received from an external device to the charged surface of the photosensitive drum 8, and the charge in the exposed portion is eliminated, by which an electrostatic latent image is formed on the surface of the photosensitive drum 8. The electrostatic latent image is developed using developer containing toner by the developing member 81 and visualized as a toner image. The toner image borne on the photosensitive drum 8 is transferred by the transfer roller 9 to the recording material S. The transfer roller 9 is urged toward the photosensitive drum 8, and a transfer nip portion N1 is formed between the transfer roller 9 and the photosensitive drum 8. That is, the transfer roller 9 forms the transfer nip portion N1 with the image bearing member and performs a transfer operation of transferring the image from the photosensitive drum 8 to the recording material S at the transfer nip portion N1.

The recording material S is fed one sheet at a time by the feed roller 3 from the sheet feed cassette 2 and conveyed via the conveyance roller pair 4 to the registration roller pair 5. After performing skew correction of the recording material S, the registration roller pair 5 conveys the recording material S to the transfer nip portion N1 at a timing synchronized with the forming of toner image by the process cartridge 6.

The recording material S on which the toner image has been transferred by passing the transfer nip portion N1 is subjected to a fixing process of toner image by the fixing unit 10. The fixing unit 10 adopts a thermal fixing system including a fixing roller and a pressure roller that nip and press the recording material S, and a heater such as a halogen lamp or an induction heating mechanism for heating the toner image via the fixing roller. The toner image is heated, pressed and softened while passing through the nip portion between the fixing roller and the pressure roller, and thereafter cooled and hardened, by which the image fixed to the recording material S is obtained. The recording material S having passed through the fixing unit 10 is discharged by the sheet discharge roller pair 11 from the apparatus body 1A and stacked on the sheet discharge tray 12.

When forming images on both sides of the recording material S, the recording material S having an image formed on a first side by passing through the transfer nip portion N1 and the fixing unit 10 is subjected to switch back by the sheet discharge roller pair 11 and sent to a reconveyance path 1R below the main conveyance path 1P. The recording material S having reached the registration roller pair 5 is passed through the transfer nip portion N1 and the fixing unit 10 again, by which an image is formed to a second side, before being discharged by the sheet discharge roller pair 11.

Separation Mechanism of Transfer Roller

Figure 2:
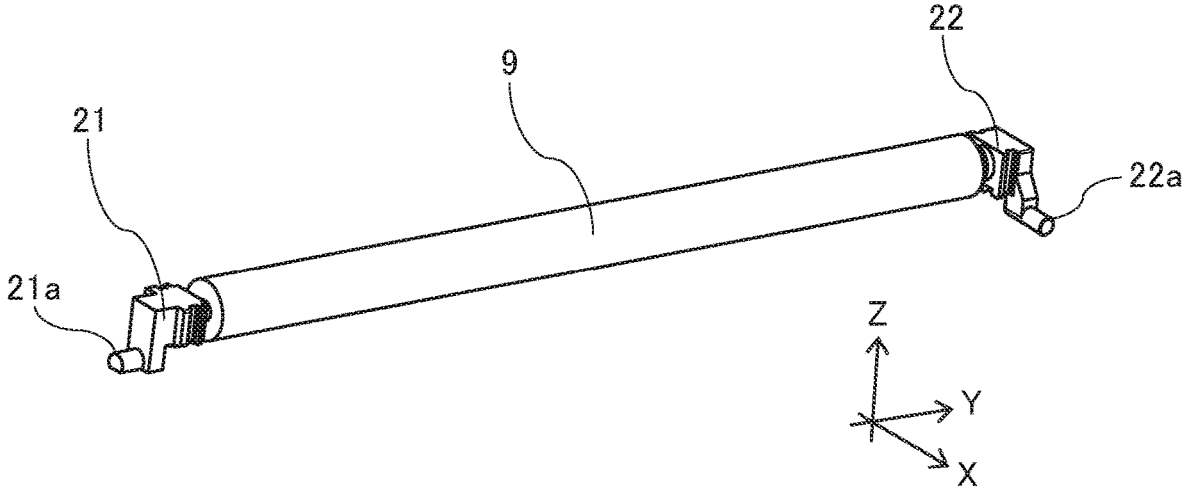
FIG. 2 is a perspective view of a transfer roller according to the first embodiment.
Figure 3:
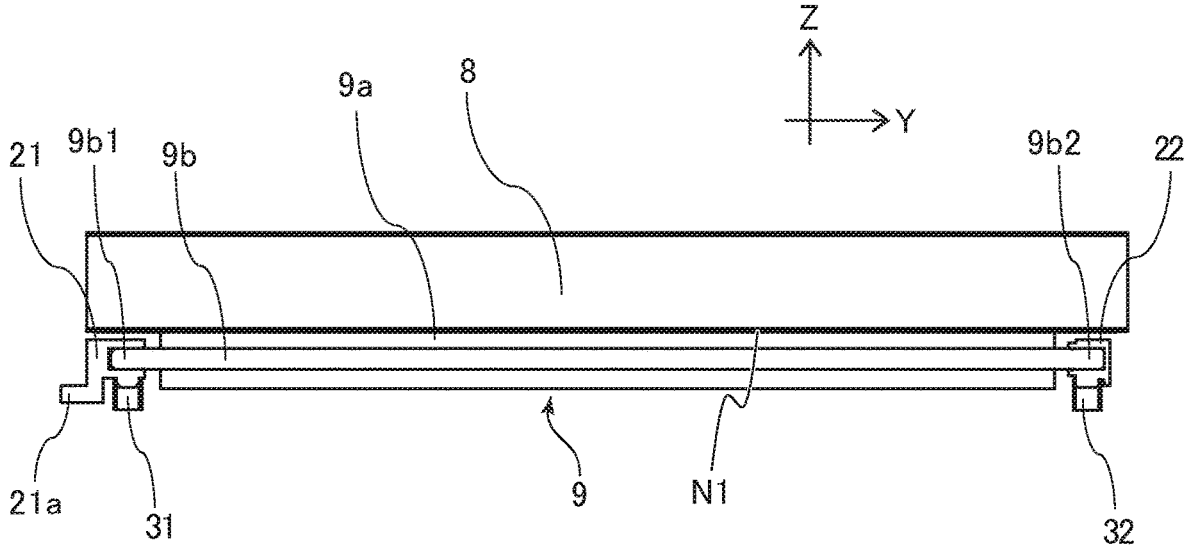
FIG. 3 is a cross-sectional view of a transfer roller and a photosensitive drum according to the first embodiment.

Next, a separation mechanism 90 for having the transfer roller 9 contact and separate from the photosensitive drum 8 will be described. FIG. 2 is a perspective view of the transfer roller 9. FIG. 3 is a cross-sectional view in which the photosensitive drum 8 and the transfer roller 9 are cut by a plane perpendicular to the X direction.

As illustrated in FIGS. 2 and 3, the transfer roller 9 includes a shaft portion 9*b* extending in the Y direction, and a tubular roller body 9*a* that is supported by the shaft portion 9*b*. One end portion, which is referred to as a first end portion 9*b*1 hereinafter, of the shaft portion 9*b* on one side (i.e., first side) in the Y direction is supported rotatably by a first bearing 21. The other end portion, which is referred to as a second end portion 9*b*2 hereinafter, of the shaft portion 9*b* on the other side (i.e., second side) in the Y direction is supported rotatably by a second bearing 22. The first bearing 21 and the second bearing 22 are respectively supported movably in the Z direction by bearing supporting portions of the apparatus body 1A.

The first bearing 21 and the second bearing 22 are respectively urged by a spring 31 and a spring 32 serving as pressing portions, i.e., urging members, for pressing the transfer nip portion N1 in a direction in which the rotational axis of the transfer roller 9 approaches the rotational axis of the photosensitive drum 8. In a state where the transfer roller 9 is positioned at a contact position described below, an outer circumference surface of the roller body 9*a* is set to be in pressure contact with the photosensitive drum 8 by a predetermined pressurizing force by the urging force of the springs 31 and 32. Further, the first bearing 21 and the second bearing 22 respectively have boss shapes 21*a* and 22*a*.

Figure 4:
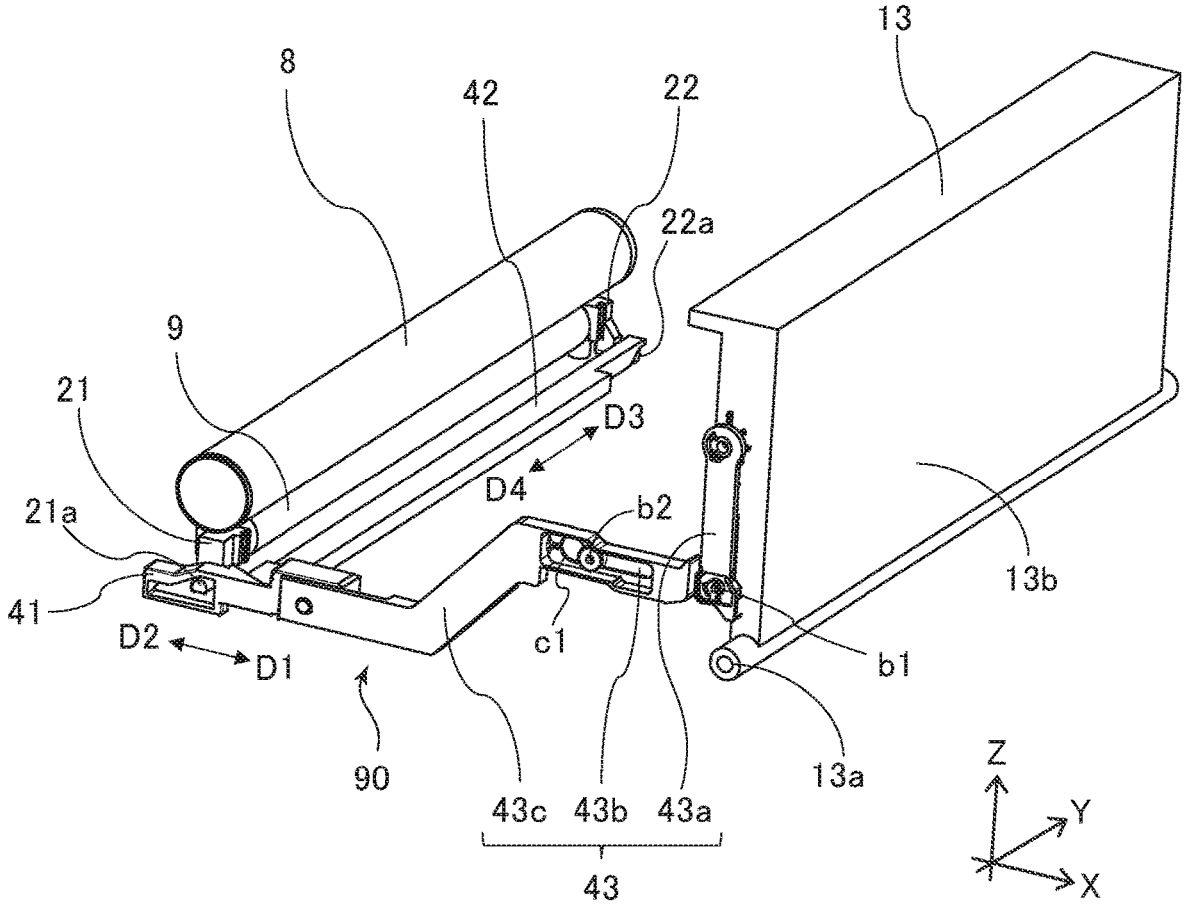
FIG. 4 is a schematic view of a separation mechanism in a first state according to the first embodiment.
Figure 5:
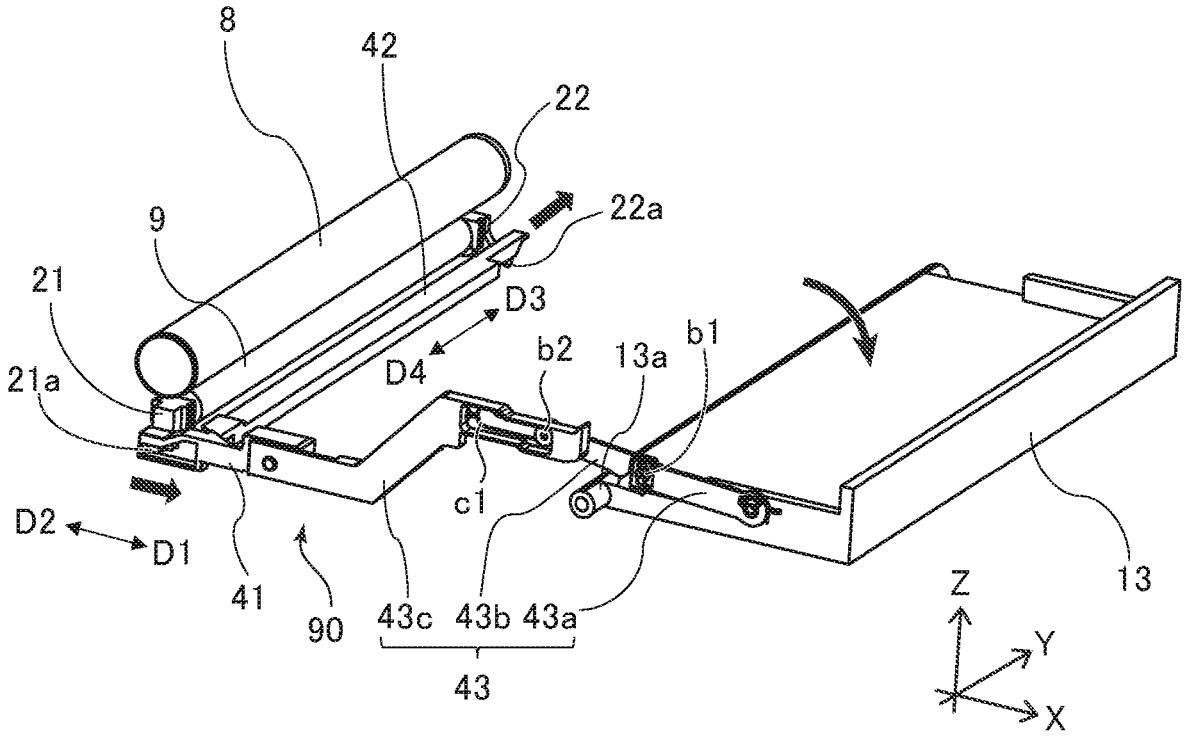
FIG. 5 is a schematic view of the separation mechanism in a second state according to the first embodiment.

FIGS. 4 and 5 are schematic views illustrating the separation mechanism 90 serving as a movement mechanism according to the present embodiment. FIG. 4 illustrates a state in which the door member 13 is at a closed position and the transfer roller 9 is at a contact state, which is hereinafter referred to as a first state of the separation mechanism 90. FIG. 5 illustrates a state where the door member 13 is at an opened position and the transfer roller 9 is at a separation state, which is hereinafter referred to as a second state of the separation mechanism 90. The contact state of the transfer roller 9 is a state in which the transfer roller 9 is in pressure contact by a predetermined pressurizing force with the photosensitive drum 8, and the separation state of the transfer roller 9 is a state in which the transfer roller 9 is separated from the photosensitive drum 8. In other words, FIG. 4 illustrates a state of the image forming apparatus 1 in which the transfer roller 9 is at a first position, also referred to as a contact position, in contact with the photosensitive drum 8, and FIG. 5 illustrates a state of the image forming apparatus 1 in which the transfer roller 9 is at a second position, also referred to as a separation position, separated from the photosensitive drum 8.

As described above, the separation mechanism 90 is configured to move the transfer roller 9 from the contact position to the separation position along with the opening operation of the door member 13. Further, the separation mechanism 90 according to the present embodiment moves the transfer roller 9 from the separation position to the contact position along with the closing operation of the door member 13.

As illustrated in FIG. 4, the separation mechanism 90 includes a separation lever 41 serving as a first movable member, i.e., first separation member, a separation rod 42 serving as a second movable member, i.e., second separation member, and a link unit 43. The boss shapes 21*a* and 22*a* (FIG. 2) which are projections formed on the first bearing 21 and the second bearing 22 of the transfer roller 9 also function as a part of the separation mechanism 90. The separation lever 41 is connected via the link unit 43 to the door member 13 and is also connected to the first bearing 21 of the transfer roller 9. The separation rod 42 is connected to the separation lever 41 and is also connected to the second bearing 22 of the transfer roller 9.

In the separation mechanism 90, the separation lever 41 and the link unit 43 are arranged on one side (i.e., first side) in the Y direction with respect to the space in which the process cartridge 6 and the main conveyance path 1P are arranged in the image forming apparatus 1. Specifically, the separation lever 41 and the link unit 43 are positioned on an outer side and on one side in the Y direction with respect to an image forming area of the photosensitive drum 8 in the Y direction, which is a maximum area of a main scanning direction in which the scanner unit 7 can form an electrostatic latent image, for example. That is, the separation lever 41 is connected to the door member 13 through an outside in the Y direction with respect to the main conveyance path 1P of the recording material S. Further, at least a part of the separation lever 41 and the link unit 43 is overlapped with the registration roller pair 5 and a conveyance guide g1 (FIG. 1) that forms the main conveyance path 1P of the recording material S via the transfer nip portion N1 when viewed in the Y direction. Further, the separation rod 42 is arranged within a space below the main conveyance path 1P and above the sheet feed cassette 2, specifically above the reconveyance path 1R. That is, the separation rod 42 is arranged below the conveyance guide g1 that guides a lower surface of the recording material S being conveyed toward the transfer nip portion N1.

The door member 13 includes a rotation shaft 13*a* (refer also to FIG. 1), disposed at a lower edge portion thereof, that is rotatably supported by a bearing portion of the apparatus body 1A, the door member capable of being opened and closed with respect to the apparatus body 1A by pivoting about a rotational axis extending in the Y direction passing through the rotation shaft 13*a*. An outer surface 13*b* of the door member 13 is an exterior that constitutes one side surface of the image forming apparatus 1 in the X direction. As illustrated in FIGS. 1 and 4, a position in which the outer surface 13*b* of the door member 13 is approximately perpendicular is referred to as a closed position of the door member 13. As illustrated in FIG. 5, a position in which the door member 13 is pivoted from the closed position to one side in the X direction is referred to as an open position of the door member 13. In the present embodiment, the door member 13 is configured to pivot approximately 90 degrees from the closed position to the open position.

The separation lever 41 is supported by the apparatus body 1A and is capable of moving in parallel, i.e., slide movement, in a D1 direction and a D2 direction that are orthogonal to the Y direction, which is the rotational axis direction of the transfer roller 9. The D1 direction is a direction along the X direction, and it is a direction along a direction in which the door member 13 moves from the closed position toward the open position. The D2 direction is a direction along the X direction, and it is a direction along a direction in which the door member 13 moves from the open position toward the closed position. The D1 and D2 directions are a first direction of the present embodiment. The D1 direction is a direction toward a first side in the first direction according to the present embodiment, and the D2 direction is a direction opposite to the D1 direction, i.e., a direction toward a second side opposite to the first side in the first direction.

The separation rod 42 is a member that is supported by the apparatus body 1A and that is elongated in the Y direction, which is the rotational axis direction of the transfer roller 9, and the separation rod 42 is capable of moving in parallel, i.e., slide movement, in a D3 direction and a D4 direction along the Y direction. The D3 direction is a direction along the Y direction and directed from the first bearing 21 toward the second bearing 22. The D4 direction is a direction along the Y direction and directed from the second bearing 22 toward the first bearing 21. The D3 and D4 directions are a second direction of the present embodiment. The D3 direction is a direction toward one side in the second direction of the present embodiment, and the D4 direction is a direction opposite to the D3 direction, i.e., a direction toward another side opposite to the one side in the second direction.

The link unit 43 connects the door member 13 and the separation lever 41, and the link unit 43 is configured to move the separation lever 41 in the D1 direction in accordance with an opening operation of the door member 13, and to move the separation lever 41 in the D2 direction in accordance with a closing operation of the door member 13. The link unit 43 according to the present embodiment includes three members, which are a first link 43*a*, a second link 43*b*, and a third link 43*c*. The first link 43*a* is attached to the door member 13 and connected pivotably to the second link 43*b*. The second link 43*b* includes a boss b1 on the D2 direction side with respect to the coupling portion with the first link 43*a*, and the second link 43*b* is connected to the third link 43*c* by having the boss b1 serving as the projection portion engage with a long hole c1 of the third link 43*c*. The third link 43*c* includes the long hole c1 at the end portion on the D1 direction side, and the third link 43*c* is connected to the separation lever 41 at the end portion on the D2 direction side.

When the door member 13 moves from the closed position (FIG. 4) to the open position (FIG. 5), the first link 43*a* pivots together with the door member 13, and the second link 43*b* moves in the D1 direction by being pulled by the first link 43*a*. By having the boss b1 of the second link 43*b* engage with the end portion on the D1 direction side of the long hole c1 of the third link 43*c*, the third link 43*c* is also moved in the D1 direction. By the movement of the third link 43*c* in the D1 direction, the separation lever 41 moves in the D1 direction.

When the door member 13 moves from the open position (FIG. 5) to the closed position (FIG. 4), the first link 43*a* pivots together with the door member 13, and the second link 43*b* is pushed back by the first link 43*a* to move in the D2 direction. Since the boss b1 of the second link 43*b* moves in the D2 direction inside the long hole c1 of the third link 43*c*, the third link 43*c* will not receive force in the D2 direction from the second link 43*b*. The third link 43*c* moves in the D2 direction in accordance with the closing operation of the door member 13 by having the end portion in the D1 direction pushed by the first link 43*a* or the door member 13 in the D2 direction. Alternatively, an urging member such as a spring that urges the third link 43*c* in the D2 direction can be arranged, and the third link 43*c* can move in the D2 direction by the urging force of the urging member in accordance with the closing operation of the door member 13.

As described, by the separation lever 41 moving in the D1 direction or the D2 direction along with the opening and closing operation of the door member 13, a separation operation or a contact operation of the transfer roller 9 as described hereafter is performed.

Movement of First Bearing

Figure 6:
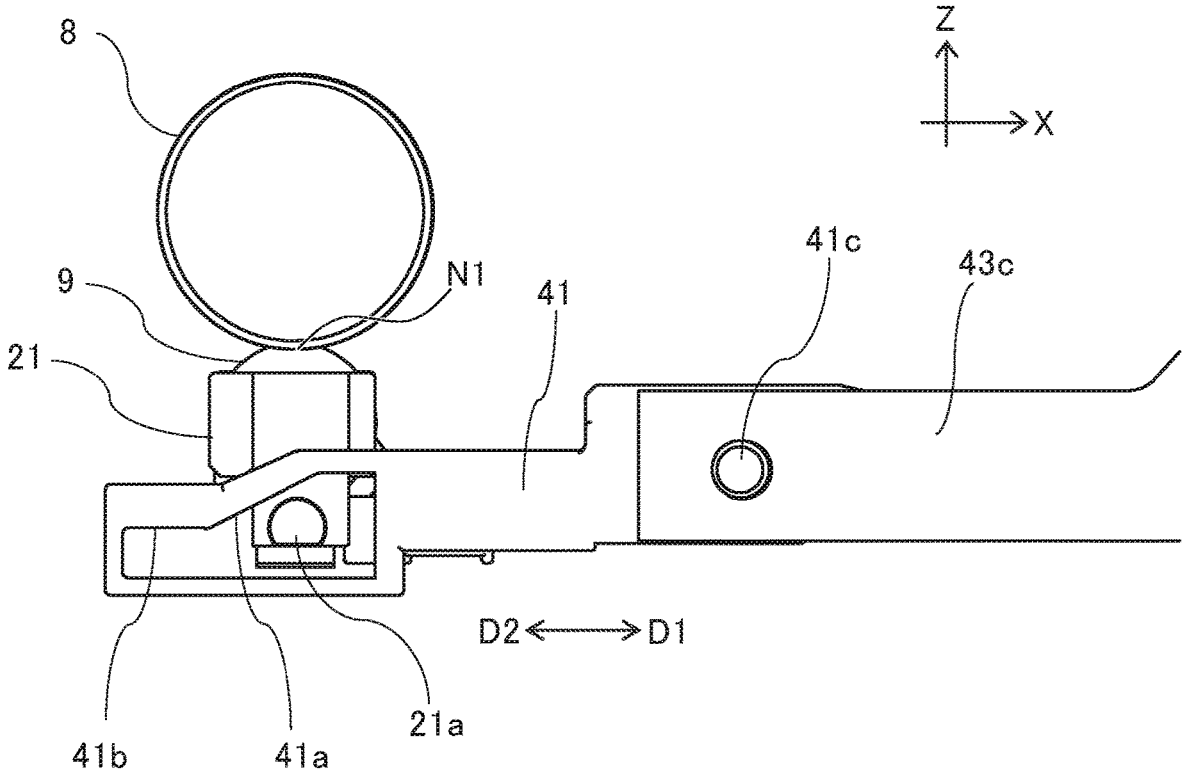
FIG. 6 is a view illustrating an area including a first bearing and a separation lever according to the first embodiment.
Figure 7:
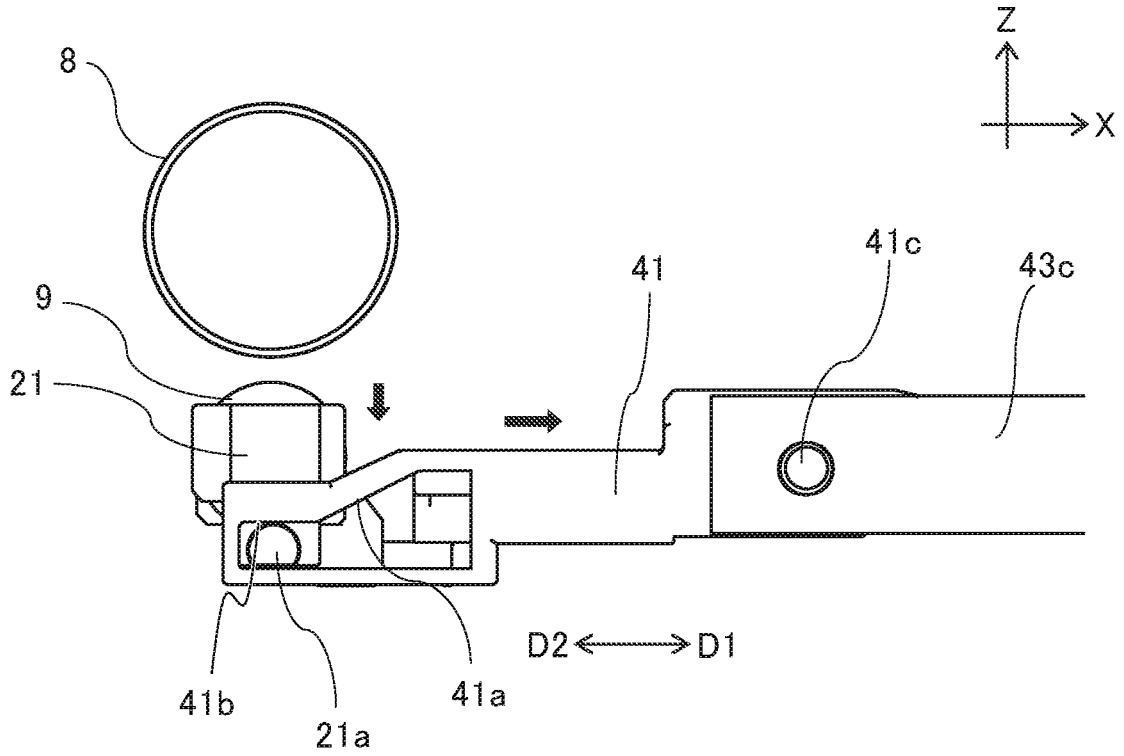
FIG. 7 is a view illustrating an area including the first bearing and the separation lever according to the first embodiment.

Next, a movement of the first bearing 21 of the transfer roller 9 in accordance with the opening and closing operation of the door member 13 will be described with reference to FIGS. 6 and 7. FIGS. 6 and 7 illustrate an area including the first bearing 21 and the separation lever 41 are viewed in the Y direction, wherein FIG. 6 corresponds to a state in which the transfer roller 9 is in the contact position, and FIG. 7 corresponds to a state in which the transfer roller 9 is in the separation position.

As illustrated in FIGS. 6 and 7, the separation lever 41 includes an inclined surface portion 41*a* and a lock portion 41*b*, and a boss 41*c* which is a connecting portion connected to an end portion of the link unit 43. The inclined surface portion 41*a*, i.e., first inclined surface, and the lock portion 41*b* can contact a boss shape 21*a*, i.e., first contact portion, of the first bearing 21 from above. The inclined surface portion 41*a* is an inclined surface inclined upward toward the downstream side in the D1 direction when viewed in the Y direction. That is, the inclined surface portion 41*a* is inclined toward an upstream side, i.e., D2 direction, in the direction of movement of the separation lever 41 in accordance with the opening operation of the door member 13 in a direction, i.e., third direction, in which the rotational axis of the transfer roller 9 is separated from the rotational axis of the photosensitive drum 8. The inclined surface portion 41*a* of the separation lever 41 and the boss shape 21*a* of the first bearing 21 function as a first cam portion which is a translation cam (i.e., linear motion cam) that converts a movement of the separation lever 41 in the D1 direction accompanying the opening of the door member 13 to a movement in a downward direction which is a direction separating the transfer roller 9 from the photosensitive drum 8. Alternately, a first inclined surface whose normal direction is opposite to that of the inclined surface portion 41*a* of the present embodiment can be provided on the first bearing 21, and a boss-shaped first contact portion that comes into contact with the first inclined surface can be provided on the separation lever 41.

The lock portion 41*b* is a surface that extends in the D2 direction at an approximately fixed height from an end portion at the D2 direction side of the inclined surface portion 41*a*, that is, a lower end portion of the inclined surface portion 41*a*. The height of the lock portion 41*b* corresponds to a height of an upper surface of the boss shape 21*a* in a state where the first bearing 21 is at a position corresponding to the separation position of the transfer roller 9. The end portion at the D1 direction side of the inclined surface portion 41*a* extends to a position higher than the upper surface of the boss shape 21*a* corresponding to the contact position of the transfer roller 9. The movement of the first bearing 21 to the D1 and D2 directions is regulated.

As described, in a state where the door member 13 is at the closed position, the separation lever 41 is positioned at the D2 direction side within the movement range. In this state, as illustrated in FIG. 6, the transfer roller 9 is in pressure contact with the photosensitive drum 8 by the urging force of the spring 31 mentioned above in a state where the inclined surface portion 41*a* of the separation lever 41 is separated upward from the boss shape 21*a* of the first bearing 21.

When the door member 13 is being opened, the separation lever 41 moves in the D1 direction in accordance with a movement of the door member 13. The separation lever 41 moves while pressing the boss shape 21*a* of the first bearing 21 downward by the inclined surface portion 41*a*, thereby moving the first bearing 21 downward, that is, moving the transfer roller 9 in the direction separating from the photosensitive drum 8. Then, before the separation lever 41 reaches a position corresponding to the open position of the door member 13, the boss shape 21*a* slips beneath the lock portion 41*b*, and the first bearing 21 is retained at a position corresponding to the separation position of the transfer roller 9. That is, the separation lever 41 serving as a first movable member moves in the D1 direction, i.e., toward the first side in the first direction, along with the opening operation of the door member 13, by which the first end portion 9*b*1 of the transfer roller 9 is moved from the contact position to the separation position.

Meanwhile, when the door member 13 is closed, the separation lever 41 moves in the D2 direction in accordance with a movement of the door member 13. In this state, after the lock portion 41*b* is released from the boss shape 21*a*, the first bearing 21 is gradually moved upward while maintaining contact between the boss shape 21*a* and the inclined surface portion 41*a*. When the transfer roller 9 comes into contact with the photosensitive drum 8, the movement of the first bearing 21 is stopped. The first bearing 21 will be retained at a position corresponding to the contact position of the transfer roller 9 by the urging force of the spring 31.

As described, the separation lever 41 is configured to move in the X direction orthogonal to the rotational axis of the transfer roller 9 by receiving force from the door member 13 via the link unit 43. Then, the separation lever 41 moves the first bearing 21 provided at one end portion of the transfer roller 9 to the position corresponding to the separation position and to the position corresponding to the contact position of the transfer roller 9 in accordance with the opening and closing operation of the door member 13.

Movement of Second Bearing

Figure 8:
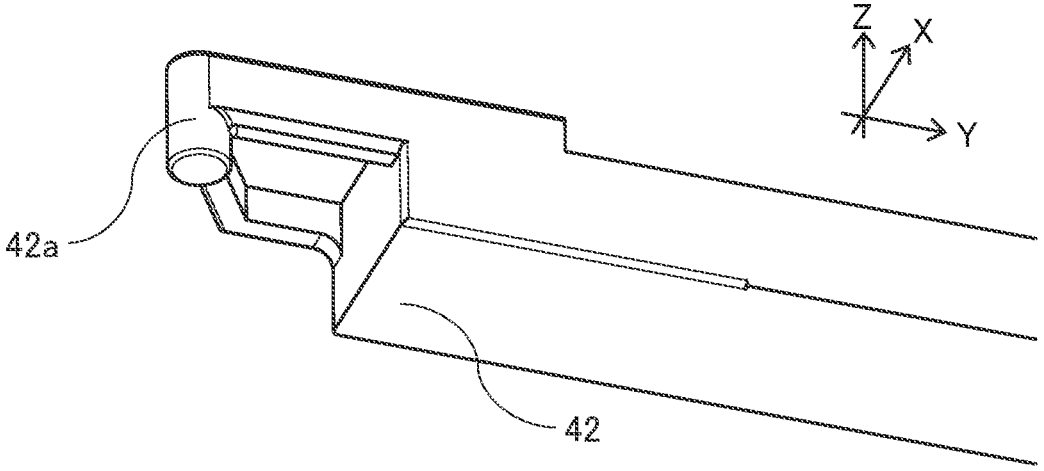
FIG. 8 is a perspective view illustrating a part of a separation rod according to the first embodiment.
Figure 9A:
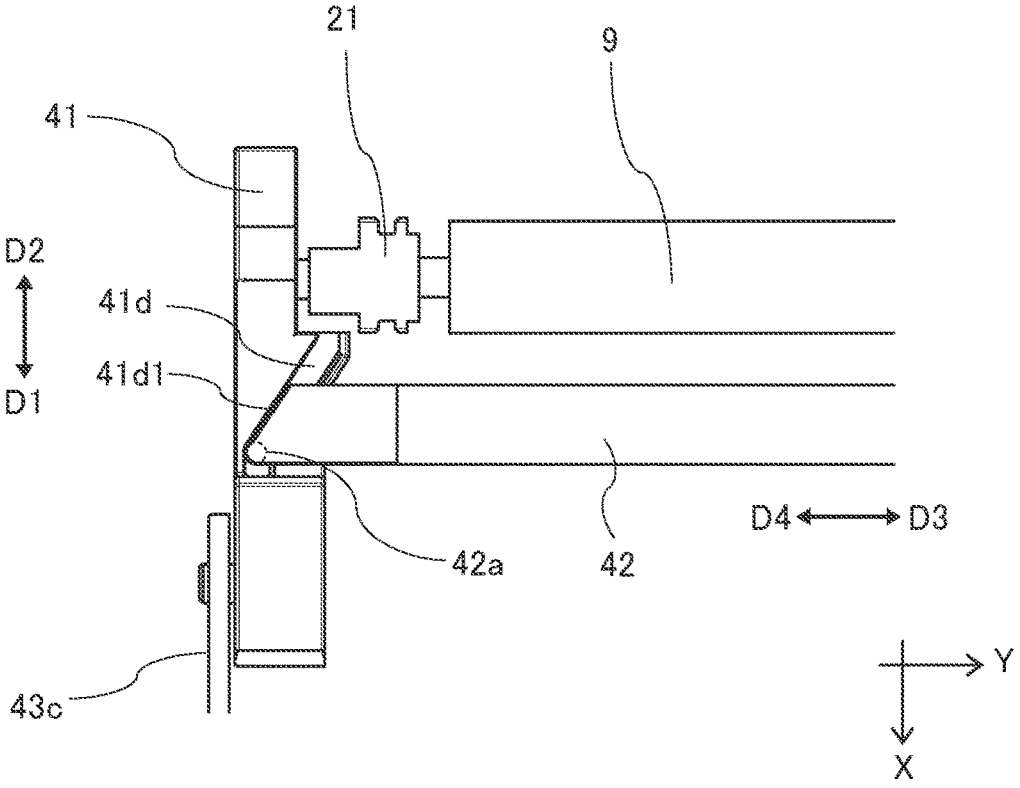
FIGS. 9A and 9B are each an illustration of a part of the separation lever and the separation rod according to the first embodiment.
Figure 9B:
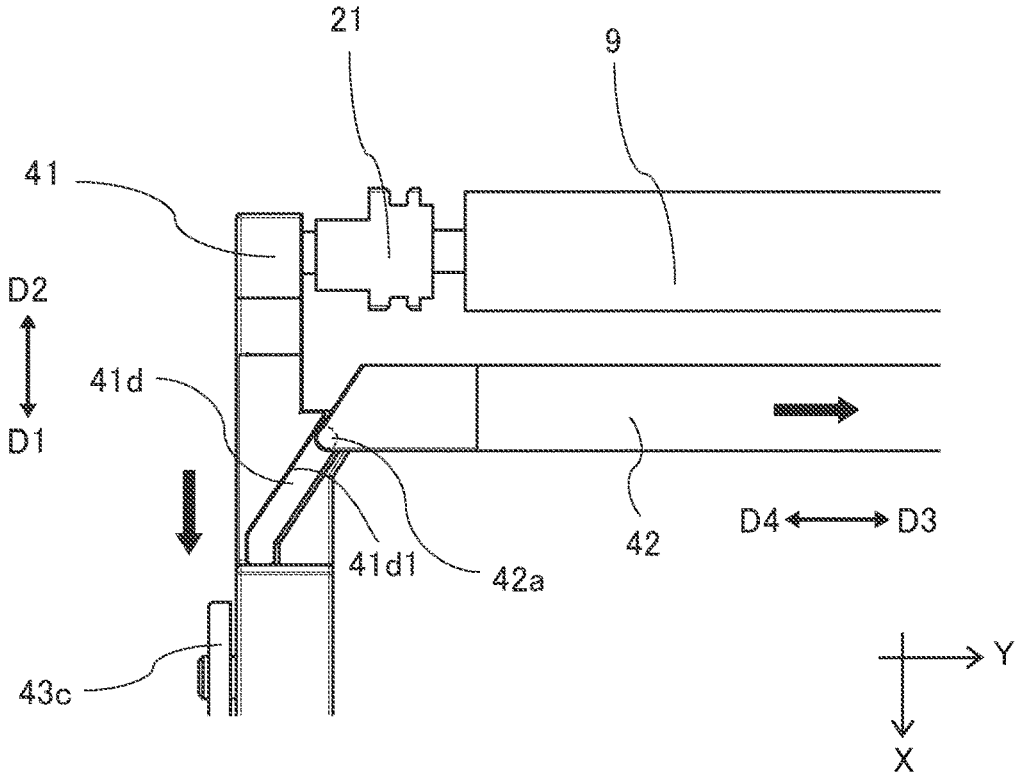
Figure 10A:
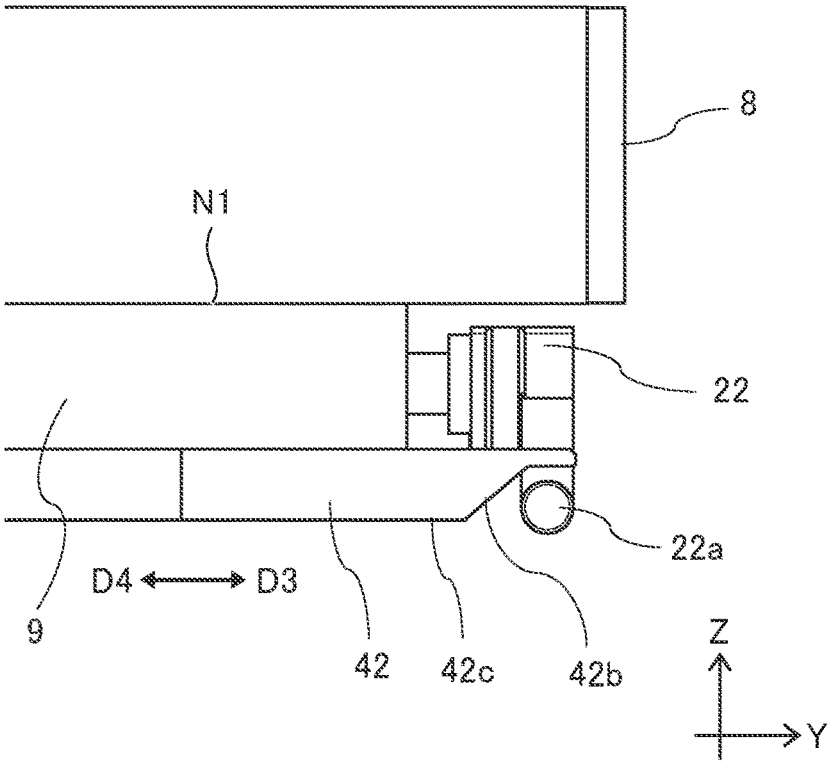
FIGS. 10A and 10B are each an illustration of a part of a second bearing and the separation rod according to the first embodiment.
Figure 10B:
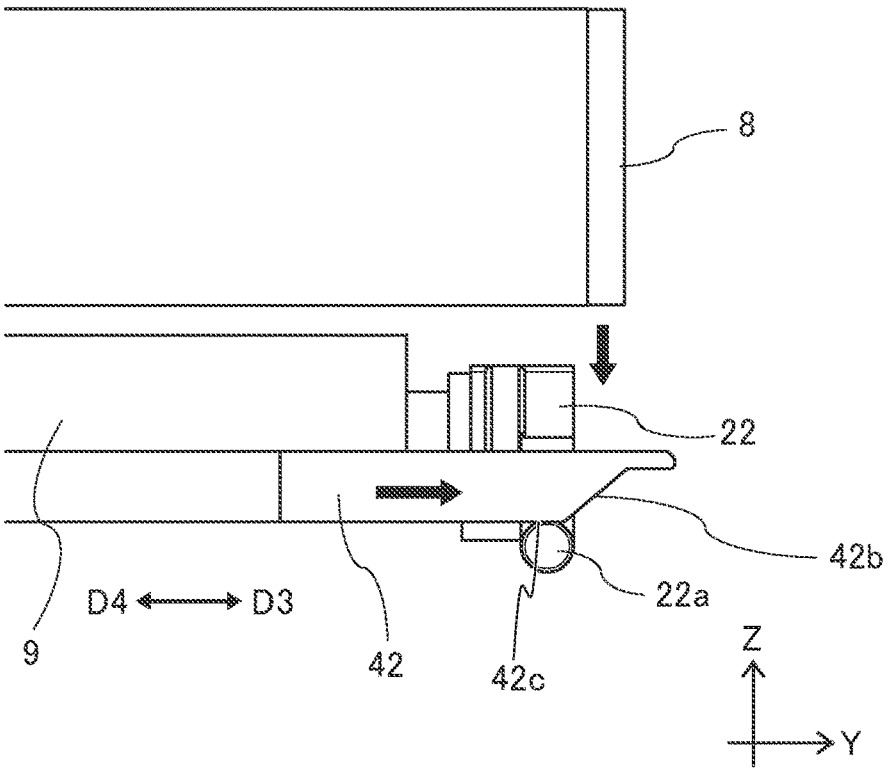

Next, the movement of the second bearing 22 of the transfer roller 9 in accordance with the opening and closing operation of the door member 13 will be described with reference to FIGS. 8 to 10. FIG. 8 is a perspective view illustrating a part of the D3 direction side, that is, the separation lever 41 side, of the separation rod 42. FIGS. 9A and 9B illustrate the separation lever 41 and the separation rod 42 viewed from an upward direction, wherein FIG. 9A corresponds to a state in which the transfer roller 9 is at the contact position and FIG. 9B corresponds to a state in which the transfer roller 9 is at the separation position. FIGS. 10A and 10B illustrate the separation rod 42 and the second bearing 22 viewed from the door member 13 side in the X direction, wherein FIG. 10A corresponds to a state in which the transfer roller 9 is at the contact position and FIG. 10B corresponds to a state in which the transfer roller 9 is at the separation position.

As illustrated in FIG. 8, the separation rod 42 includes an engagement portion 42*a* at the end portion on the D4 direction side, and the engagement portion 42*a* is engaged with a groove portion 41*d* of the separation lever 41 illustrated in FIG. 9A. When viewed from above, the groove portion 41*d* is inclined in the D4 direction side toward the downstream side in the D1 direction. In other words, the groove portion 41*d* includes an inclined surface 41*d*1, i.e., second inclined surface, that is inclined toward one side in a sliding direction of the separation rod 42 toward the direction of movement of the separation lever 41 when the door member 13 is opened. The inclined surface 41*d*1 slides against the engagement portion 42*a*, i.e., second contact portion, and presses the separation rod 42 in the D3 direction when the door member 13 is being opened. The movement of the separation rod 42 to the D1 and D2 directions is regulated. The groove portion 41*d* of the separation lever 41 and the engagement portion 42*a* of the separation rod 42 function as a second cam portion, which is a translation cam that converts the movement of the separation lever 41 in the D1 direction and the D2 direction into the movement of the separation rod 42 in the D3 direction and the D4 direction. Alternatively, a second inclined surface having a normal direction opposite to that of the inclined surface 41*d*1 according to the present embodiment can be provided on the separation rod 42, and an engagement portion, i.e., second contact portion, that comes into contact with the second inclined surface can be provided on the separation lever 41.

As illustrated in FIG. 10A, the separation rod 42 includes an inclined surface portion 42*b* and a lock portion 42*c*. When viewed in the X direction, the inclined surface portion 42*b* is an inclined surface, i.e., third inclined surface, that is inclined upward toward the downstream side in the D3 direction. That is, the inclined surface portion 42*b* is inclined toward a side in which the transfer roller 9 is moved away from the photosensitive drum 8 toward the upstream side, i.e., the D4 direction, in the moving direction of the separation rod 42 in accordance with the opening operation of the door member 13. The inclined surface portion 42*b* of the separation rod 42 and a boss shape 22*a*, i.e., third contact portion, of the second bearing 22 function as a third cam portion, which is a translation cam that converts the movement of the separation rod 42 in the D3 direction accompanying the opening of the door member 13 to a downward movement of separating the transfer roller 9 from the photosensitive drum 8. Alternatively, a third inclined surface having a normal direction opposite to that of the inclined surface portion 42*b* according to the present embodiment can be provided on the second bearing 22, and a third contact portion such as a boss shape that comes into contact with the third inclined surface can be provided on the separation rod 42.

A height of the lock portion 42*c* corresponds to the separation position of the transfer roller 9. The lock portion 42*c* is a surface that extends in the D4 direction at an approximately fixed height from an end portion at the D4 direction side of the inclined surface portion 42*b*, that is, a lower end portion of the inclined surface portion 42*b*. The end portion at the D3 direction side of the inclined surface portion 42*b* extends to a position higher than the upper surface of the boss shape 22*a* corresponding to the contact position of the transfer roller 9. The movement of the second bearing 22 to the D3 and D4 directions is regulated.

As described, when the door member 13 is at the closed position, the separation lever 41 is positioned at the D2 direction side position within the movement range. In that state, as illustrated in FIG. 9A, the separation rod 42 is positioned at the D4 direction side position within the movement range. Then, as illustrated in FIG. 10A, in a state where the inclined surface portion 42*b* of the separation rod 42 is separated upward from the boss shape 22*a* of the second bearing 22, the transfer roller 9 is in pressure contact with the photosensitive drum 8 by the urging force of the spring 32 mentioned above.

When the door member 13 is opened, the separation lever 41 moves in the D1 direction in accordance with the door member 13, as illustrated in FIG. 9B. In that state, the engagement portion 42*a* is guided along the groove portion 41*d* of the separation lever 41, and the separation rod 42 moves in the D3 direction (FIG. 9A to FIG. 9B). The separation rod 42 moves while pushing down the boss shape 22*a* of the second bearing 22 by the inclined surface portion 42*b*, and moves the second bearing 22 downward, that is, in a direction separating the transfer roller 9 from the photosensitive drum 8. Then, before the separation rod 42 reaches a position corresponding to the open position of the door member 13, the boss shape 22*a* slips beneath the lock portion 42*c*, and the second bearing 22 is retained at a position corresponding to the separation position of the transfer roller 9. That is, the separation rod 42 serving as a second movable member moves in the D3 direction, i.e., toward one side in the second direction, along with the movement of the separation lever 41 in the D1 direction, i.e., toward the first side in the first direction, when the door member 13 is opened, by which the second end portion 9*b*2 of the transfer roller 9 is moved from the contact position to the separation position.

Meanwhile, when the door member 13 is closed, the separation lever 41 moves in the D2 direction in accordance with a movement of the door member 13. The engagement portion 42*a* is guided along the groove portion 41*d* of the separation lever 41, and the separation rod 42 is moved in the D4 direction (FIG. 9B to FIG. 9A). After the lock portion 42*c* is released from the boss shape 22*a*, the second bearing 22 is gradually moved upward while maintaining contact between the boss shape 22*a* and the inclined surface portion 42*b*. When the transfer roller 9 comes into contact with the photosensitive drum 8, the movement of the second bearing 22 is stopped. The second bearing 22 will be retained at a position corresponding to the contact position of the transfer roller 9 by the urging force of the spring 32.

As described, the separation rod 42 moves in a direction approximately parallel to the rotational axis of the transfer roller 9, by which a part of an operation force for opening the door member 13 is transmitted via the separation rod 42 to a side opposite from the link unit 43 and the separation lever 41 in the Y direction. Thereby, the second bearing 22 on the side opposite from the first bearing 21 moved by the separation lever 41 is moved using the operation force of the door member 13, and the transfer roller 9 can be separated from the photosensitive drum 8 while having the first bearing 21 and the second bearing 22 cooperate with each other.

Since a configuration in which the separation rod 42 that is elongated in the Y direction (i.e., a thin and narrow member extending in the Y direction) moves in the direction along the Y direction to transmit the above-mentioned operation force, torsional force and bending force is not easily applied on the separation rod 42. There is no need to use a metal material having a high strength or to increase the cross-sectional area on the assumption that torsional force or bending force will act on the separation rod 42, so that a strength required of the separation rod 42 can be ensured while realizing lower cost and saving space.

The height of the lock portion 42*c* of the separation rod 42 is determined to correspond to the height of the lock portion 41*b* of the separation lever 41 with the height of the rotational axis of the transfer roller 9 set as reference. That is, in a state where the lock portions 41*b* and 42*c* of the separation lever 41 and the separation rod 42 are in contact with the boss shapes 21*a* and 22*a* of the first bearing 21 and the second bearing 22, the rotational axis of the transfer roller 9 is in parallel with the rotational axis of the photosensitive drum 8.

Further, inclination angles of the inclined surface portions 41*a* and 42*b* of the separation lever 41 and the separation rod 42 may preferably be set so that the moving velocities of the first bearing 21 and the second bearing 22 in the Z direction in accordance with the opening and closing of the door member 13 are equal. Thereby, the transfer roller 9 separates from the photosensitive drum 8 while maintaining a posture parallel to the photosensitive drum 8 in accordance with the opening operation of the door member 13. For example, if the inclination angle of the separation lever 41 with respect to the X direction of the groove portion 41*d* is 45 degrees, the ratio of the moving velocity of the separation lever 41 in the D1 direction to the moving velocity of the separation rod 42 in the D2 direction accompanying the opening operation of the door member 13 is one to one. In this case, if the inclination angles of the inclined surface portions 41*a* and 42*b* with respect to the horizontal plane are set equal, the first bearing 21 and the second bearing 22 will move downward at the same speed.

Summary of Present Embodiment

As described, according to the present embodiment, the transfer roller 9 is separated from the photosensitive drum 8 by the separation lever 41 moving in the D1 direction accompanying the opening operation of the door member 13 and the separation rod 42 moving in the D3 direction accompanying the movement of the separation lever 41 in the D1 direction. Thereby, after performing the opening operation of the door member 13, the process cartridge 6 can be detached or attached without having to perform a special operation for separating the transfer roller 9, which contributes to improving usability. Further according to the present embodiment, the first end portion of the transfer roller 9 is moved by the separation lever 41 connected to the door member 13, and the second end portion of the transfer roller 9 is moved by the separation rod 42 connected to the separation lever 41. Thereby, the separation mechanism 90 for moving both end portions of the transfer roller 9 accompanying the opening operation of the door member 13 can be realized by a space-saving configuration.

Further, the space opposite to the separation lever 41 and the link unit 43 in the Y direction within the apparatus body 1A can be utilized effectively as a space for arranging components other than the separation mechanism 90. For example, a motor or a drive transmission mechanism for driving the photosensitive drum 8 or the registration roller pair 5 can be arranged in a space opposite to the separation lever 41 and the link unit 43 in the Y direction within the apparatus body 1A.

The present embodiment adopts a configuration in which the link unit 43 is composed of three members (43*a*, 43*b*, and 43*c*), but a link unit can be composed of one member, for example, as long as it moves the separation lever 41 in the D1 direction or the D2 direction in accordance with the opening and closing operation of the door member 13. Further, the separation lever 41 can be extended in the X direction to be directly connected to the door member 13.

Second Embodiment

Next, an image forming apparatus according to a second embodiment will be described with reference to FIGS. 11 to 16. Hereafter, elements that have substantially the same configurations and functions as those in the first embodiment are denoted with the same reference numerals as the first embodiment, and descriptions thereof are omitted.

Figure 11:
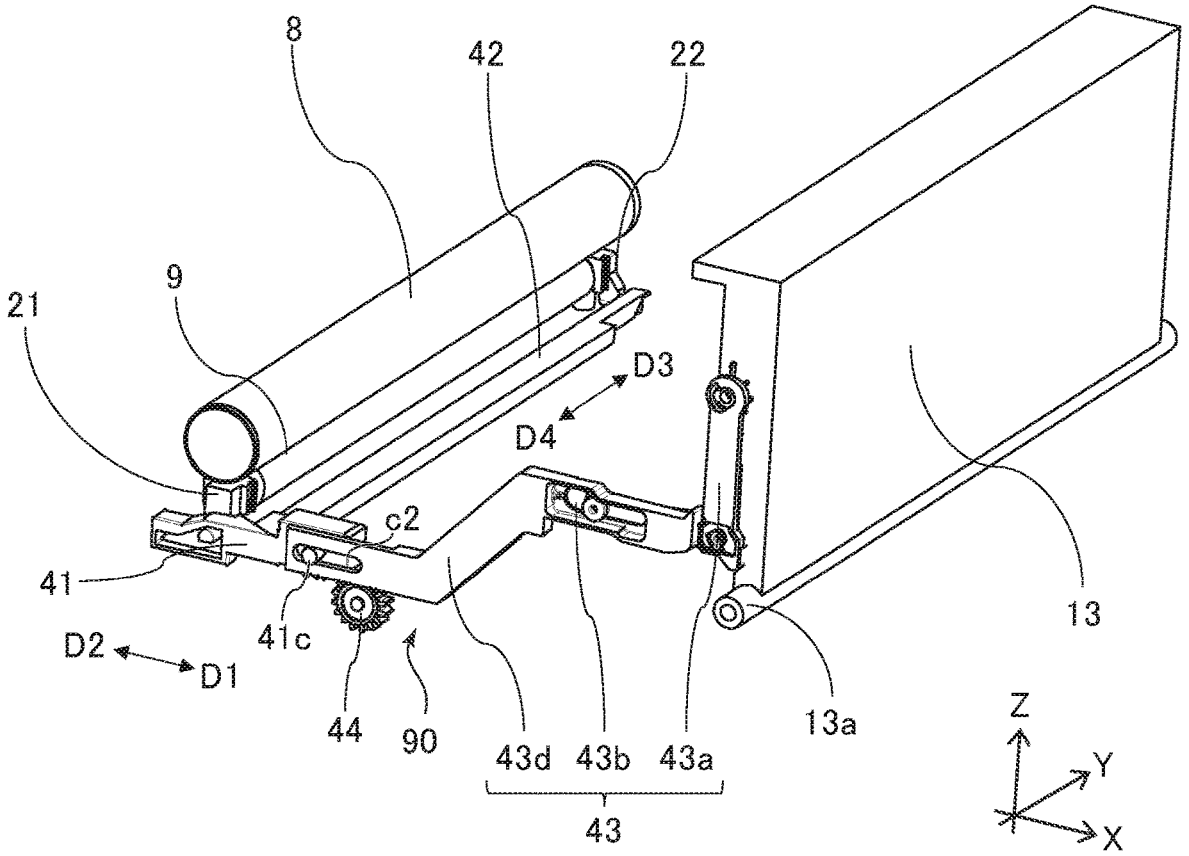
FIG. 11 is a schematic view illustrating a separation mechanism in a first state according to a second embodiment.
Figure 12:
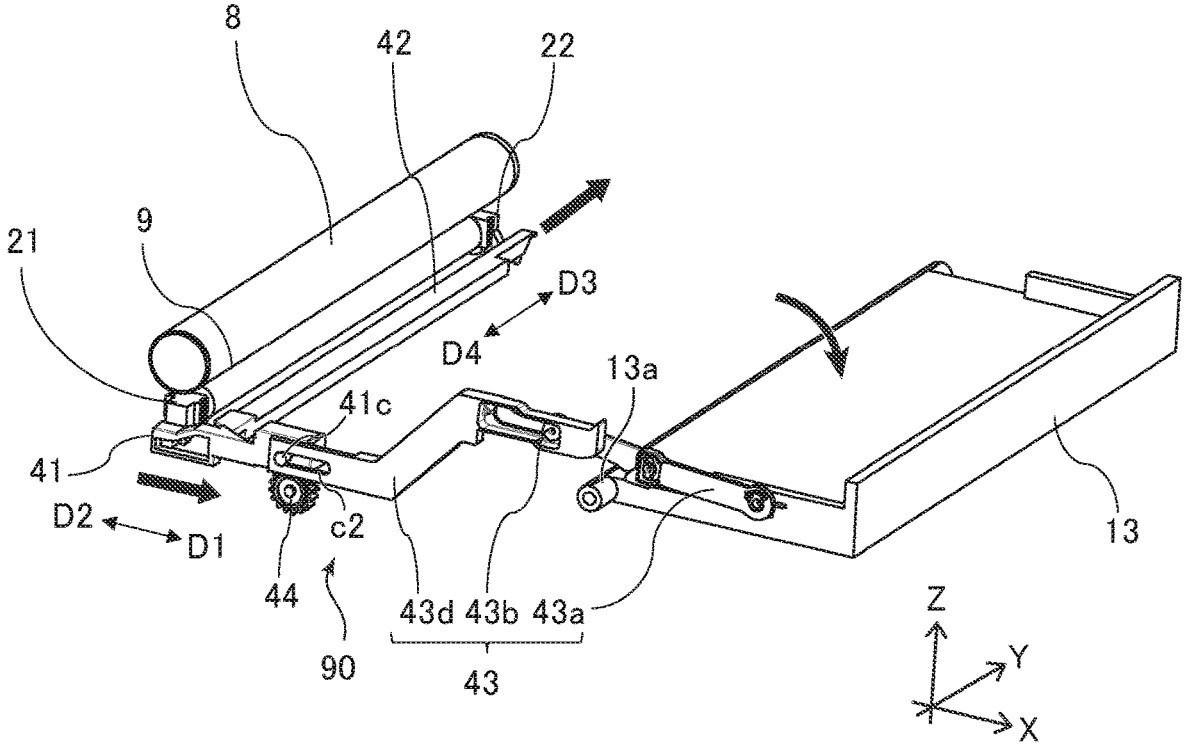
FIG. 12 is a schematic view illustrating the separation mechanism in a second state according to the second embodiment.

FIGS. 11 and 12 are schematic views illustrating a separation mechanism 90 serving as a movement mechanism according to the present embodiment. FIG. 11 illustrates a contact state in which the transfer roller 9 is positioned at a first position, i.e., contact position. FIG. 12 illustrates a separation state in which the transfer roller 9 is positioned at the second position, i.e., separation position.

In the first embodiment, a configuration has been illustrated in which the transfer roller 9 is not only moved in accordance with the opening operation of the door member 13 but the transfer roller 9 is also moved in accordance with the closing operation of the door member 13. In contrast, according to the present embodiment, the transfer roller 9 maintains a separation position even when the door member 13 is closed in a state where the transfer roller 9 is positioned at the separation position, and thereafter, the transfer roller 9 is moved from the separation position to the contact position by the driving force of the driving source.

As illustrated in FIG. 11, a third link 43*d* which is one of the link members constituting a link unit 43 according to the present embodiment includes a long hole c2 of a long round or oval shape that extends in the D1 direction and serves as an engagement portion with the separation lever 41. The boss 41*c* of the separation lever 41 is engaged with the long hole c2.

Further, a driving gear 44 that serves as a driving unit for driving the separation mechanism 90 after the door member 13 has been closed is arranged below the separation lever 41. A rack portion 41*e* (FIG. 14) that extends in the D1 direction is provided on the separation lever 41, and the driving gear 44 is meshed with the rack portion 41*e*. The driving gear 44 is driven by a motor 51 provided on the apparatus body 1A and moves the separation lever 41 in the D2 direction.

Separation Operation of Transfer Roller

Figure 14:
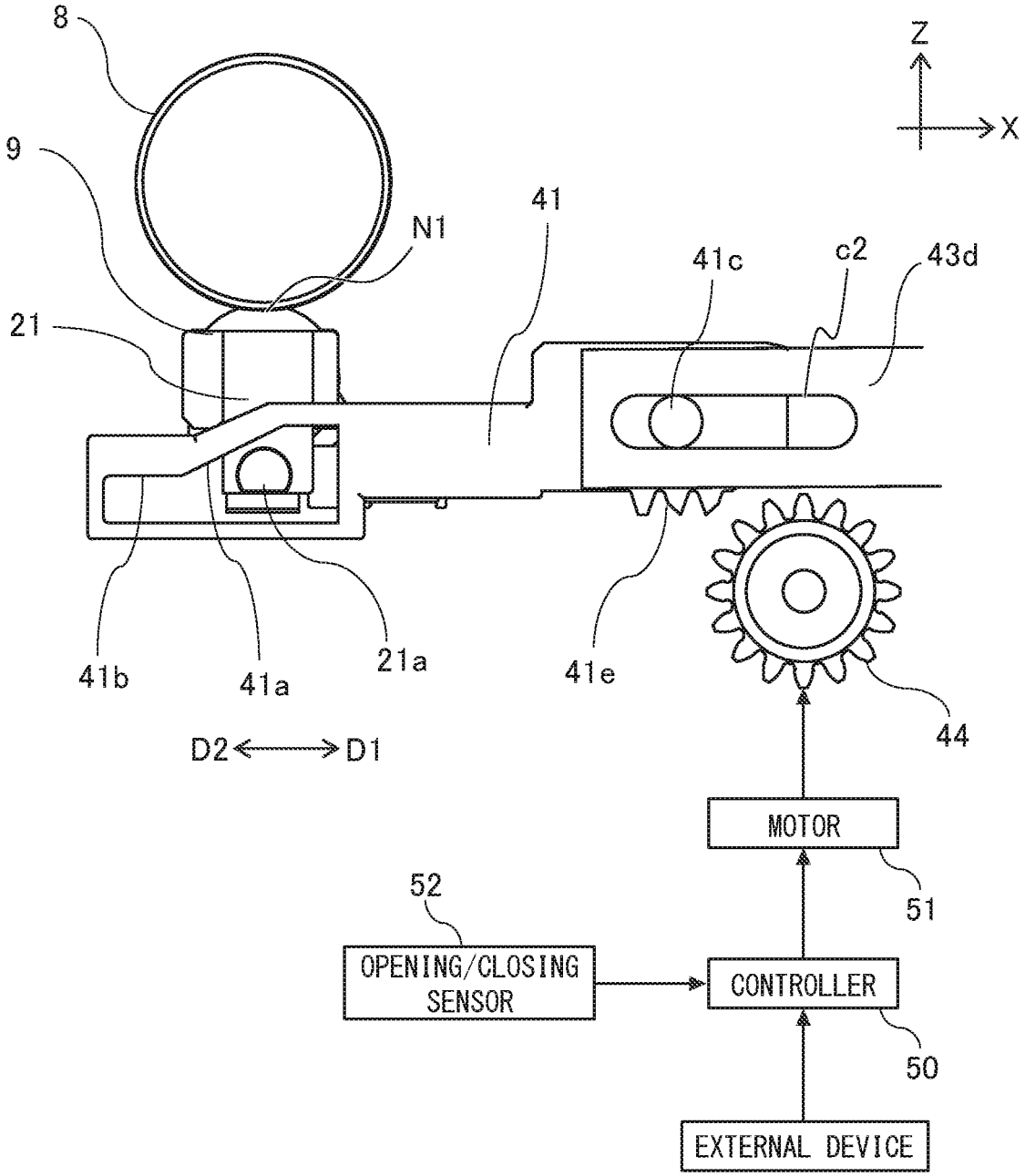
FIG. 14 is a view illustrating a part of the separation mechanism in the first state according to the second embodiment.
Figure 15:
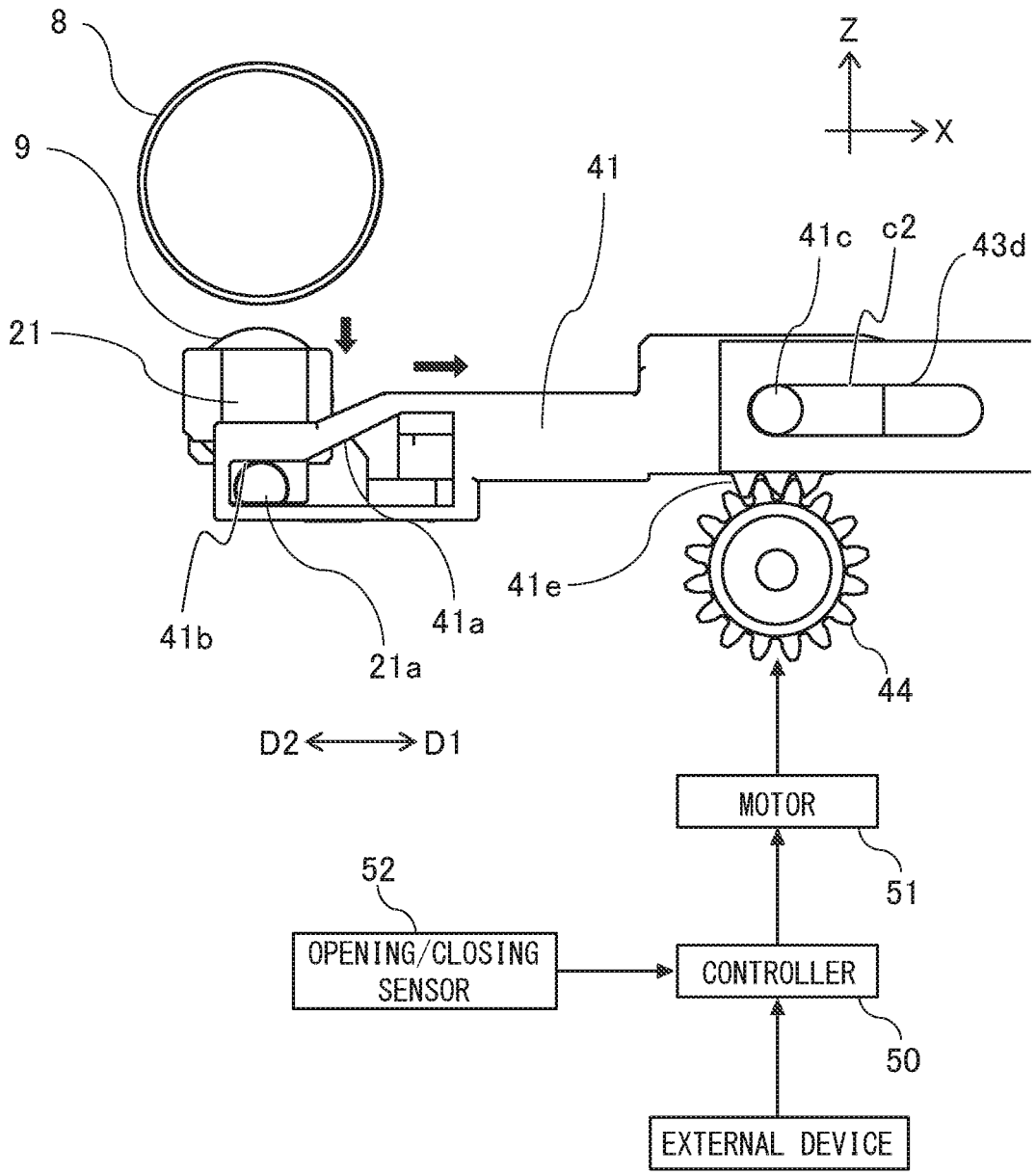
FIG. 15 is a view illustrating a part of the separation mechanism in the second state according to the second embodiment.
Figure 16:
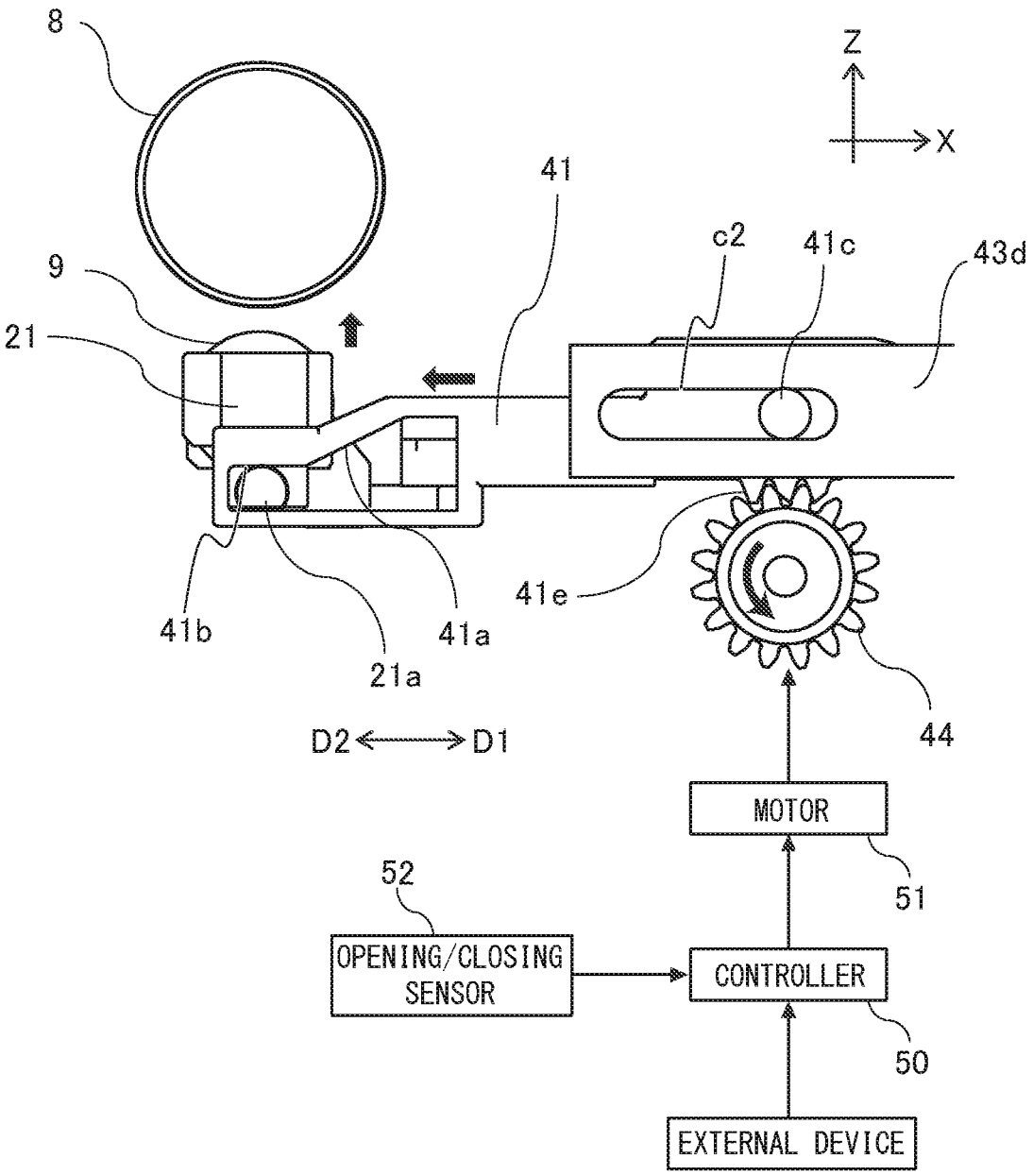
FIG. 16 is a view illustrating a part of the separation mechanism in the third state according to the second embodiment.

An operation of moving the transfer roller 9 from the contact position to the separation position along with the opening operation of the door member 13 will be described with reference to FIGS. 14 to 16. FIGS. 14 to 16 are views illustrating an area including the separation lever 41 and the driving gear 44 in the Y direction. FIG. 14 illustrates a state in which the door member 13 is at a closed position and the transfer roller 9 is at a contact position. FIG. 15 illustrates a state where the door member 13 is at an open position. FIG. 16 illustrates a state immediately after closing of the door member 13 in which the transfer roller 9 is positioned at the separation position.

When the door member 13 is opened, similar to the first embodiment, the separation lever 41 is moved in the D1 direction in accordance with the opening operation of the door member 13 by the link unit 43 (FIGS. 11 and 12). However, in the present embodiment, the long hole c2 of the separation lever 41 is engaged with the boss 41*c* of the third link 43*d* of the link unit 43 (FIG. 14). Therefore, when the end portion on the D2 direction side of the long hole c2 comes into contact with the boss 41*c*, the movement of the separation lever 41 in the D1 direction is started.

As illustrated in FIG. 15, while the door member 13 moves to the open position, the inclined surface portion 41*a* of the separation lever 41 pushes down the boss shape 21*a* of the first bearing 21, and the position of the first bearing 21 is determined by the lock portion 41*b*. During this operation, the rack portion 41*e* of the separation lever 41 meshes with the driving gear 44. Along with the movement of the separation lever 41 in the D1 direction, the separation rod 42 moves in the D3 direction, the inclined surface portion 42*b* pushes down the boss shape 22*a* of the second bearing 22, and the position of the second bearing 22 is determined by the lock portion 42*c* (FIG. 10A to FIG. 10B). Thereby, in a state where the door member 13 is at the open position, the transfer roller 9 is positioned at the separation position.

Figure 13:
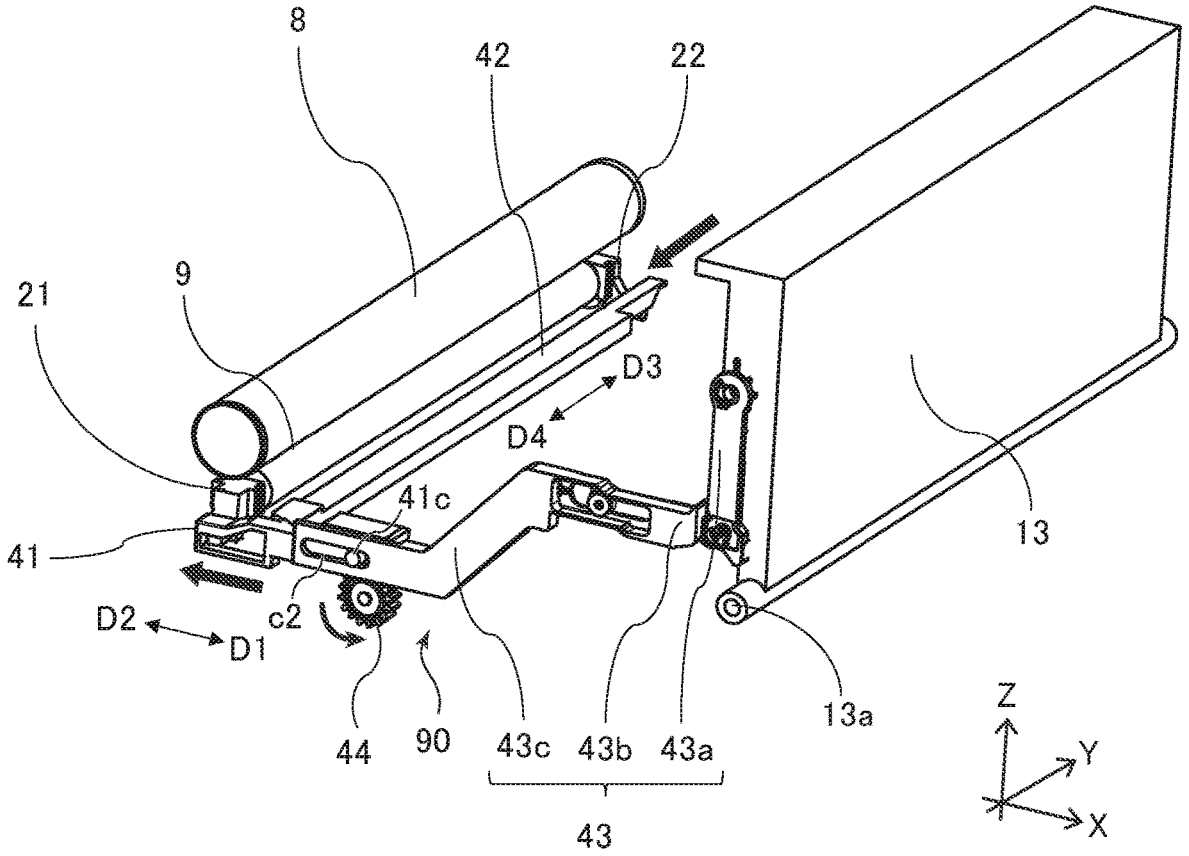
FIG. 13 is a schematic view illustrating the separation mechanism in a third state according to the second embodiment.

When the door member 13 is closed, the third link 43*d* of the link unit 43 is moved in the D2 direction in accordance with the closing operation of the door member 13 (FIG. 13).

However, at a point of time where the door member 13 has reached the closed position, the boss 41*c* of the separation lever 41 is not engaged with either end portions of the long hole c2 of the third link 43*d*, and the separation lever 41 maintains the same position as where it was positioned before the door member 13 has been closed. Therefore, at this point of time, neither the first bearing 21 nor the second bearing 22 has moved from the position where they were positioned before the closing of the door member 13, and the transfer roller 9 is maintained at the separation position.

That is, the separation mechanism 90 of the present embodiment is configured such that the separation lever 41 is moved in the D1 direction in accordance with the door member 13 via the link unit 43 only during the opening operation among the opening and closing operations of the door member 13.

Contact Operation of Transfer Roller

Next, an operation to move the transfer roller 9 from the separation position to the contact position will be described. As illustrated in FIG. 16, when the door member 13 is closed in a state where the transfer roller 9 is at the separation position, the driving gear 44 is driven to rotate in a counterclockwise direction in the drawing. Then, the separation lever 41 is driven by the driving gear 44 and moves in the D2 direction. In this state, the boss 41*c* of the separation lever 41 moves inside the long hole c2 of the third link 43*d* in the D2 direction.

By the movement of the separation lever 41 in the D2 direction, the lock portion 41*b* is disengaged from the boss shape 21*a* of the first bearing 21, and the first bearing 21 moves upward by the urging force of the spring 31. Further, along with the movement of the separation lever 41 in the D2 direction, similar to the first embodiment, the separation rod 42 moves in the D4 direction and the lock portion 42*c* is disengaged from the boss shape 22*a* of the second bearing 22, and the second bearing 22 moves upward by the urging force of the spring 32 (FIG. 10B to FIG. 10A). Thereby, the movement of the transfer roller 9 from the separation position to the contact position is completed. Further, the length and the position of the rack portion 41*e* is set so that drive transmission from the driving gear 44 to the separation lever 41 is automatically cutoff when the rack portion 41*e* of the separation lever 41 is disengaged from the driving gear 44 after the transfer roller 9 has moved to the contact position.

As described, according to the present embodiment, at a point of time when the door member 13 is closed, the transfer roller 9 is positioned at the separation position. Therefore, the transfer roller 9 can be positioned at the separation state during shipping, thereby reducing the demerit of having the photosensitive drum 8 and the transfer roller 9 be in pressure contact with each other for a long time, which may cause deformation of the transfer roller 9 or adhesion of components of the transfer roller 9 to the photosensitive drum 8.

Further according to the present embodiment, a contact timing of the transfer roller 9 and the photosensitive drum 8 can be determined arbitrarily by controlling the operation of the driving gear 44. The image forming apparatus 1 includes a controller 50 that controls the motor 51 (FIGS. 14 to 16). The controller 50 includes a storage unit that stores control programs for controlling the image forming apparatus 1, and a processor for reading the control programs from the storage unit and executing the same. The controller 50 is electrically connected with an opening/closing sensor 52 whose detection signal switches according to the opening/closing of the door member 13, and the controller 50 is connected via a network to communicate with an external device.

In order to control a contact timing of the transfer roller 9 and the photosensitive drum 8, for example, a clutch is interposed between the motor 51 and the driving gear 44, and the clutch is operated by the controller 50 to enable transmission of drive from the motor 51 to the driving gear 44 to be engaged and disengaged. An electromagnetic clutch operated based on a command signal of the controller 50 or an engaging clutch driven by a solenoid that is operated by a command signal from the controller 50 can be used as the clutch.

Based on the detection signal of the opening/closing sensor 52, the controller 50 instructs to start driving of the process cartridge 6 and start the image forming operation in a state where an execution command to form an image is received from the external device in a state where the door member 13 is closed. In this state, the controller 50 can set the driving of the driving gear 44 to be started at a delayed timing from the starting of drive of the process cartridge 6.

For example, a case is assumed in which the user opens the door member 13, replaces the process cartridge 6 and closes the door member 13, and thereafter, enters an execution command of image forming from the external device to the image forming apparatus 1. In that case, at a point of time when the controller 50 detects that the door member 13 has been closed based on the detection signal of the opening/closing sensor 52, the driving gear 44 is not driven by the motor 51, and the transfer roller 9 is retained at the separation position. Thereafter, in a state in which the execution command for image forming is entered, the controller 50 drives the process cartridge 6 while maintaining the separation state of the transfer roller 9. Thereafter, after the position of the process cartridge 6 is stabilized, the clutch is engaged to drive the driving gear 44 by the motor 51, and the transfer roller 9 comes into contact with the photosensitive drum 8. Thereby, the risk of having the transfer roller 9 come into pressure contact with the photosensitive drum 8 while the process cartridge 6 is displaced from the attachment position and causing the process cartridge 6 to be in an incomplete attachment state can be prevented reliably. The motor can also function as a driving source for driving the photosensitive drum 8 of the process cartridge 6.

Other Example

In the first and second embodiments, the transfer roller 9 is moved to the separation position by the separation lever 41 or the separation rod 42 pushing down the first bearing 21 and the second bearing 22 retaining the transfer roller 9. Alternately, a configuration in which the transfer roller 9 is moved to the separation position by the separation lever 41 or the separation rod 42 directly pressing the roller shaft of the transfer roller 9 can be adopted.

OTHER EMBODIMENTS

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-030499, filed on Feb. 26, 2021, which is hereby incorporated by reference herein in its entirety.

What is claimed is:

1. An image forming apparatus comprising:

an image bearing member configured to bear an image;

an apparatus body including a transfer member configured to transfer the image borne on the image bearing member to a recording material, the transfer member being movable between a first position in which the transfer member is in contact with the image bearing member and a second position in which the transfer member is separated from the image bearing member; and a door arranged on a side portion of the apparatus body on a first side in a first direction and movable between an open position and a closed position with respect to the apparatus body, the first direction being a direction orthogonal to a rotational axis direction of the image bearing member, wherein the apparatus body further includes a movement mechanism configured to move the transfer member in accordance with a movement of the door, and wherein the movement mechanism includes:

a first link configured to move toward the first side in the first direction in accordance with the movement of the door from the closed position to the open position, the first link being configured to move a first end portion of the transfer member from the first position to the second position during a movement of the first link toward the first side in the first direction, the first link being provided on a first end side, on which the first end portion is provided, in the rotational axis direction, and a second link configured to move in a second direction along the rotational axis direction in accordance with the movement of the first link toward the first side in the first direction, the second link being configured to move a second end portion of the transfer member from the first position to the second position during a movement of the second link in the second direction, the second end portion being provided on a second end side opposite from the first end side in the rotational axis direction.

2. The image forming apparatus according to claim 1, further comprising a process cartridge including the image bearing member, wherein in a state where the door is at the open position, the process cartridge is exposed to an outside of the apparatus body and is allowed to be attached to and detached from the apparatus body.

3. The image forming apparatus according to claim 2, wherein when viewed in the second direction, the image bearing member and the transfer member are arranged on a conveyance path through which the recording material is conveyed toward a second side opposite to the first side in the first direction, wherein the apparatus body includes a supporting portion provided on an upper surface portion of the apparatus body, the supporting portion being configured to support the recording material on which image is formed and which is discharged from the apparatus body toward the first side in the first direction, and wherein the process cartridge is attached in a space between the conveyance path and the supporting portion in a vertical direction.

4. The image forming apparatus according to claim 3, further comprising a conveyance guide configured to guide the recording material conveyed toward a transfer nip portion formed by the image bearing member contacting the transfer member, wherein the first link is configured to be connected with the door via an outside of the conveyance path in the rotational axis direction, and wherein the second link is arranged on a side opposite to the conveyance path with respect to the conveyance guide.

5. The image forming apparatus according to claim 1, wherein in a case where the door is moved from the open position to the closed position in a state where the transfer member is at the second position, the transfer member is configured to be retained at the second position at a point of time when the door reaches the closed position, and thereafter to be moved from the second position to the first position before an image forming operation for the recording material is started.

6. The image forming apparatus according to claim 5, further comprising:

a driving unit configured to drive the movement mechanism; and a controller configured to control the driving unit, wherein after the door is moved from the open position to the closed position in a state where the transfer member in at the second position, the controller is configured to control the driving unit to drive the movement mechanism so that the transfer member is moved from the second position to the first position.

7. The image forming apparatus according to claim 6, wherein, in a case where an execution command for the image forming operation is entered after the door is moved from the open position to the closed position in a state where the transfer member is at the second position, the controller is configured to start driving of the image bearing member and thereafter to control the driving unit to drive the movement mechanism so that the transfer member is moved from the second position to the first position.

8. The image forming apparatus according to claim 6, wherein the first link includes a rack portion extending in the first direction, and wherein the driving unit includes a driving source and a gear meshed with the rack portion and configured to be driven to rotate by the driving source.

9. The image forming apparatus according to claim 5, wherein the movement mechanism includes a link member configured to connect the door and the first link, a long hole provided on one of the first link and the link member and elongated in the first direction, and a projection provided on the other one of the first link and the link member and configured to be engaged with the long hole, wherein, in a case where the door is at the open position, the link member is configured to move the first link toward the first side in the first direction by the projection being in contact with an end portion of the long hole, and wherein, in a case where the door is at the closed position in a state where the transfer member is at the second position, the link member is configured to move toward a second side opposite to the first side in the first direction by the projection moving within the long hole such that the first link is retained at a position of the first link before of the door is closed.

10. The image forming apparatus according to claim 1, wherein, in a case where the door is moved from the open position to the closed position in a state where the transfer member is at the second position, the transfer member is configured to be moved from the second position to the first position by the movement mechanism in accordance with the movement of the door from the open position to the closed position.

11. The image forming apparatus according to claim 1, wherein the movement mechanism includes:

a first cam portion configured to convert the movement of the first link toward the first side in the first direction to a movement of the first end portion of the transfer member in a third direction, the third direction being a direction that intersects the first direction and the second direction and that is directed toward a rotational axis of the transfer member from a rotational axis of the image bearing member, a second cam portion configured to convert the movement of the first link toward the first side in the first direction to the movement of the second link in the second direction, and a third cam portion configured to convert the movement of the second link in the second direction to a movement of the second end portion of the transfer member in the third direction, and wherein the first cam portion, the second cam portion and the third cam portion are each a translation cam.

12. The image forming apparatus according to claim 11, further comprising:

a first bearing configured to support the first end portion of the transfer member rotatably; and a second bearing configured to support the second end portion of the transfer member rotatably, wherein the first cam portion includes a first inclined surface provided on either one of the first link and the first bearing and inclined to one side in the third direction toward the first side in the first direction, and a first contact portion provided on the other one of the first link and the first bearing and configured to slide against the first inclined surface, wherein the second cam portion includes a second inclined surface provided on either one of the first link and the second link and inclined to one side in the second direction toward the first side in the first direction, and a second contact portion provided on the other one of the first link and the second link and configured to slide against the second inclined surface, wherein the third cam portion includes a third inclined surface provided on either one of the second link and the second bearing and inclined to one side of the third direction toward a downstream side in the second direction, and a third contact portion provided on the other one of the second link and the second bearing and configured to slide against the third inclined surface, and wherein an inclination angle of the first inclined surface, the second inclined surface and the third inclined surface is set such that the transfer member separates from the image bearing member in accordance with the movement of the door while maintaining a posture in which a rotational axis of the transfer member is in parallel with a rotational axis of the image bearing member.

* * * * *